United States Patent [19]

Akachi et al.

[11] Patent Number: 4,635,019

[45] Date of Patent: Jan. 6, 1987

[54] COIL APPARATUS WITH DIVIDED WINDINGS

[75] Inventors: Yoshiaki Akachi; Takeo Matsumaru, both of Chiba, Japan

[73] Assignee: TDK Corporation, Tokyo, Japan

[21] Appl. No.: 765,704

[22] Filed: Aug. 14, 1985

[30] Foreign Application Priority Data

Aug. 21, 1984 [JP] Japan ..... 59-173715

[51] Int. Cl.[4] ..... H01F 27/28

[52] U.S. Cl. ..... 336/180; 336/183; 336/208; 336/222

[58] Field of Search ..... 336/180, 182, 183, 185, 336/198, 208, 222, 223, 62, 94

[56] References Cited

U.S. PATENT DOCUMENTS

| | | | |
|---|---|---|---|
| 1,781,308 | 11/1930 | Vos | 336/182 |
| 1,873,824 | 8/1932 | Cole et al. | 336/183 X |
| 3,213,397 | 10/1965 | Broverman | 336/198 X |
| 3,579,165 | 5/1971 | Johnson | 336/183 X |
| 3,594,672 | 7/1971 | Frenkel | 336/183 X |
| 3,904,928 | 9/1975 | Sawada et al. | 336/94 X |
| 3,946,349 | 3/1976 | Haldeman, III | 336/62 |
| 4,229,786 | 10/1980 | Mitani et al. | 336/185 X |
| 4,335,423 | 1/1982 | Koizumi et al. | 336/183 X |
| 4,460,885 | 7/1984 | Hensen et al. | 336/183 X |
| 4,549,042 | 10/1985 | Akiba et al. | 174/114 R |

*Primary Examiner*—Thomas J. Kozma

*Attorney, Agent, or Firm*—Wyatt, Gerber, Shoup, Scobey & Badie

[57] ABSTRACT

A coil apparatus for the use of a switching power supply circuit has been found. The coil apparatus having two overlapped coil bobbins has an improved winding arrangement. This arrangement is such that one ($P_1$) of primary windings which are provided for an inner bobbin are divided into two windings ($P_{11}$, $P_{12}$) which are electrically coupled with each other, and remaining primary windings ($P_2$) are sandwiched between the two divided windings ($P_{11}$, $P_{12}$).

4 Claims, 10 Drawing Figures

COIL APPARATUS WITH DIVIDED WINDINGS

BACKGROUND OF THE INVENTION

The present invention relates to a coil apparatus and, in particular, to a winding arrangement of a coil apparatus comprising two overlapped coil bobbins. The present invention can be utilized as a power converting transformer in a switching power supply circuit.

FIG. 1 is a cross sectional view of a conventional coil apparatus having a single coil bobbin. This coil bobbin 1 has a hollow cylindrical or rectangular member and flanges located on both the extreme ends of the hollow member. A primary winding P is fitted on the hollow member. An insulation film 2 is provided around the primary winding P. Furthermore, a secondary winding S is fitted on the film 2. In this arrangement, the primary winding P is electrically coupled with a switching circuit (not shown) and the secondary winding S is electrically coupled with a load (not shown). Of course, a core (not shown) made of magnetic material is inserted into the hollow member.

FIG. 2 is a cross sectional view of another conventional coil apparatus using two overlapped coil bobbins. One coil bobbin 3, referred to as an inner coil bobbin, has a hollow cylindrical or rectangular member and two flanges on both the extreme ends thereof. The other coil bobbin 4, referred to as an outer coil bobbin, has also a hollow cylindrical or rectangular member and two flanges on both the extreme ends thereof. As apparent from FIG. 2, the diameter of the inner bobbin 3 is smaller than that of the outer bobbin 4. Then, the inner bobbin 3 is inserted into the hollow member of the outer bobbin 4. A primary winding P is fitted on the hollow member of the inner bobbin 3, a secondary winding S being fitted on the hollow member of the outer bobbin 4. In the same way as the apparatus of FIG. 1, a core (not shown) is inserted into the cylindrical member of the inner bobbin 3.

When the above-mentioned coil apparatuses are utilized in a power supply circuit, the following conditions must be satisfied.

(a) The Curie temperature of the magnetic core is sufficiently high and its maximum magnetic flux density is large.

(b) The iron loss is small in a high frequency band.

(c) The temperature characteristics of the magnetic core are satisfactory.

(d) The copper loss of the windings is small.

(e) The magnetic coupling between the windings is satisfactory.

(f) The insulation breakdown strength between windings must exceed that requested by the safety standard issued in each country.

The above conditions (a) through (c) depend on the property of the magnetic core and the condition (d) depends on both the diameter and the length of windings. Furthermore, the condition (e), depending on the winding manner or winding structure of the coil apparatus, is closely related not only to the electric performance of the coil apparatus but to the performance of the power supply circuit. For instance, with the coil apparatus used as the power converting transformer in the switching power supply circuit, if the magnetic coupling between windings is low, the leakage flux will increase and thus the leakage inductance will become large. Therefore, an energy which is stored in the leakage inductance while a switching element coupled with the primary winding is in the ON state is discharged just when the switching element changes from ON to OFF. The discharge of the stored energy induces a high voltage across the primary winding, thus causing the switching element to be damaged. Furthermore, this discharge due to the low magnetic coupling, brings about the vibration of switching waveforms which affects the switching operation, the increase of the loss and the decrease of its efficiency.

In order to improve the magnetic coupling between windings, many types of the winding manners of the coil apparatus using a single bobbin as shown in FIG. 1 have been proposed. As examples of those winding manners, there are so-called a voltage-dividing manner, a current-dividing manner, a sandwich manner and so on. FIG. 3 is a circuit diagram of a coil apparatus according to the voltage-dividing manner. As shown in FIG. 3, this apparatus has two primary windings $P_1$ and $P_2$ and a secondary winding S. The primary winding $P_1$ is divided into two windings $P_{11}$, $P_{12}$. One end of the winding $P_1$ is connected to a terminal 6, and the other to a terminal 7. One end of the winding $P_{12}$ is connected to a terminal 8, the other to the terminal 7. In this arrangement, the voltage $V_1$ applied across the terminals 6 and 8 is divided by two windings. The primary winding $P_1$ composed of two windings $P_{11}$, $P_{12}$ in a series, the other primary winding $P_2$ (which is terminated at terminals 9, 10) and the secondary winding S (which is terminated at terminals 11, 12) are disposed for the single bobbin, as shown in FIG. 4. As apparent from this figure, the secondary winding S and the primary winding $P_2$ are arranged so as to be interposed between two divided windings $P_{11}$ and $P_{12}$. An insulation film 14 is provided between the windings S and $P_2$ and an insulation film 15 is provided between the windings S and $P_{11}$ to insulate between adjacent windings.

The winding arrangement of FIG. 4 can provide the improvement of the magnetic coupling between the primary side and the secondary side. However, it is difficult to ensure a sufficient insulation voltage therebetween for satisfying the safety standards by means of the insulation films 14, 15.

On the other hand, the prior coil apparatus having two overlapped bobbins has the winding arrangement such that the primary windings $P_1$, $P_2$ are wound on the inner bobbin 3 in this order and the secondary windings on the outer bobbin 4. This arrangement can provide a sufficient insualtion breakdown strength between primary side and the secondary side for satisfying the safety standards. However, as compared with the arrangement of the coil apparatus of FIG. 4, the magnetic coupling between primary side and the secondary side is small and thus the leakage inductance is large because the length between the primary side and the secondary side is rather long. Furthermore, it is impossible for the coil apparatus having two overlapped bobbins to have the winding arrangement of the coil apparatus having a single bobbin of FIG. 4 in order to improve the magnetic coupling. Therefore, an winding arrangement for increasing the magnetic coupling between the primary coil and the secondary coil has not been proposed yet.

SUMMARY OF THE INVENTION

It is an object, therefore, of the present invention to overcome the disadvantages of a prior coil apparatus having two overlapped bobbins by a coil apparatus having an improved winding arrangement.

It is also an object of the present invention to provide a coil apparatus having a great coupling degree and a small leakage inductance.

The above and other objects are attained by a coil apparatus comprising an inner coil bobbin having a hollow member on which at least two primary windings are fitted, and an outer coil bobbin having a hollow member on which at least a secondary winding is fitted, the hollow member of the inner bobbin being inserted into the hollow member of the outer bobbin, characterized in that one of primary windings are divided into the windings which are coupled with each other and remaining primary windings are sandwiched between the two divided windings.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 5:
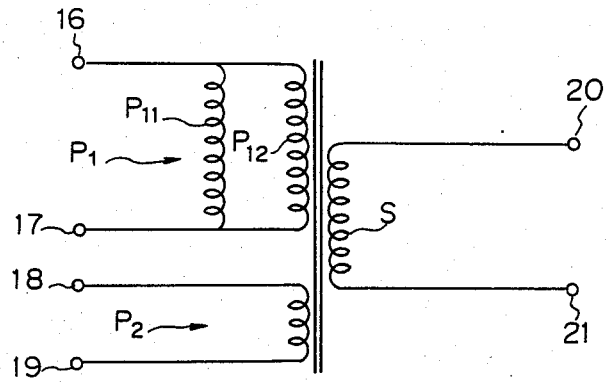
FIG. 5 is a circuit diagram of a coil apparatus according to the first embodiment of the present invention.

FIG. 5 is a circuit diagram of a coil apparatus having two overlapped coil bobbins according to the first embodiment of the present invention. In this figure, the primary side of the coil apparatus is composed of windings $P_1$ and $P_2$. The windings $P_1$ coupled with the collector of a switching element such as a transistor (not shown) handles a relatively large current. The winding $P_2$ coupled with the base of the transistor handles a relatively small current. The winding $P_1$ is divided into two windings $P_{11}$ and $P_{12}$ coupled with each other in parallel. The winding $P_1$ may be divided into two windings which are coupled with each other in series. The extreme ends of each of the windings $P_{11}$ and $P_{12}$ are connected to terminals 16 and 17 of the coil apparatus, respectively. The extreme ends of the windings $P_2$ are connected to terminals 18 and 19, respectively. On the other hand, the secondary side of the coil apparatus is composed of a winding S with the extreme ends thereof connected to terminals 20 and 21, respectively.

Figure 6:
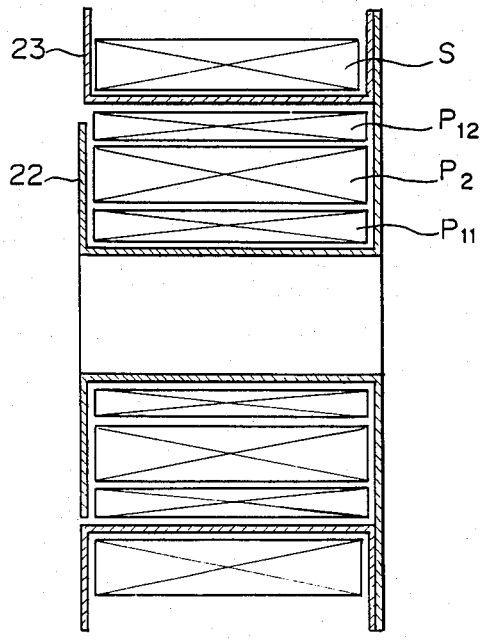
FIG. 6 is a cross sectional view of the coil apparatus according to the first emobdiment.

FIG. 6 is a cross sectional view of the coil apparatus according to the first embodiment. In this figure, an inner coil bobbin 22 made of insulation material such as resin has a hollow member around both the extreme ends of which flanges are provided. The flanges project in the direction perpendicular to the longitudinal direction of the coil apparatus. The hollow member may be in the cylindrical or rectangular shape. On outer coil bobbin 23 are formed in the similar manner to the inner bobbin 22. However, the diameter of the hollow member of the outer bobbin 23 is longer than that of the inner bobbin 22. Then, the inner bobbin 22 is inserted into the hollow member of the outer bobbin 23. Of course, a pair of E-shaped magnetic cores (not shown) are provided with the center bosses of the cores inserted through both the ends of the hollow member of the inner bobbin 22 therein.

Figure 1:
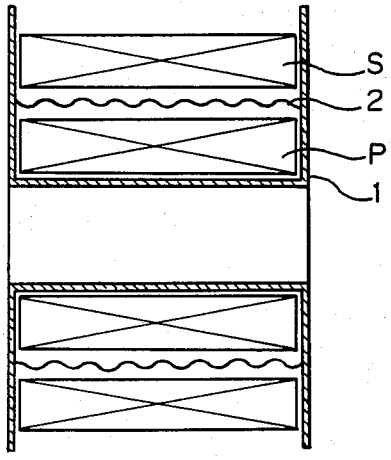
Fig. 1 PRIOR ART
FIG. 1 is a cross sectional view of a prior coil apparatus having a single coil bobbin.
Figure 2:
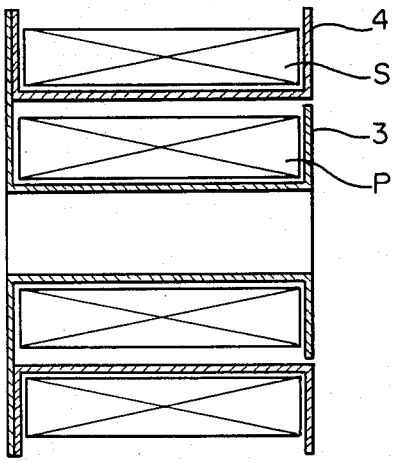
Fig. 2 PRIOR ART
FIG.2 is a cross sectional view of another piror coil apparatus having two overlapped coil bobbins.
Figure 3:
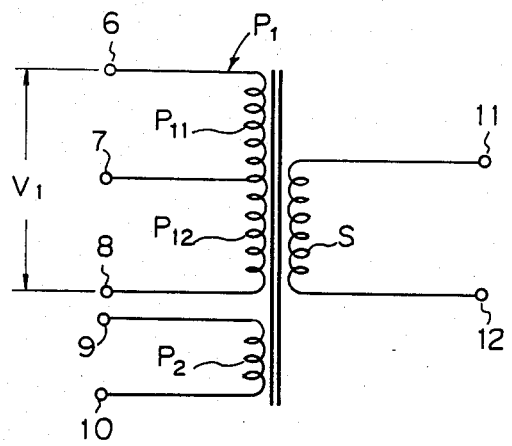
Fig. 3 PRIOR ART
FIG. 3 is a circuit diagram of still another prior coil appratus.
Figure 4:
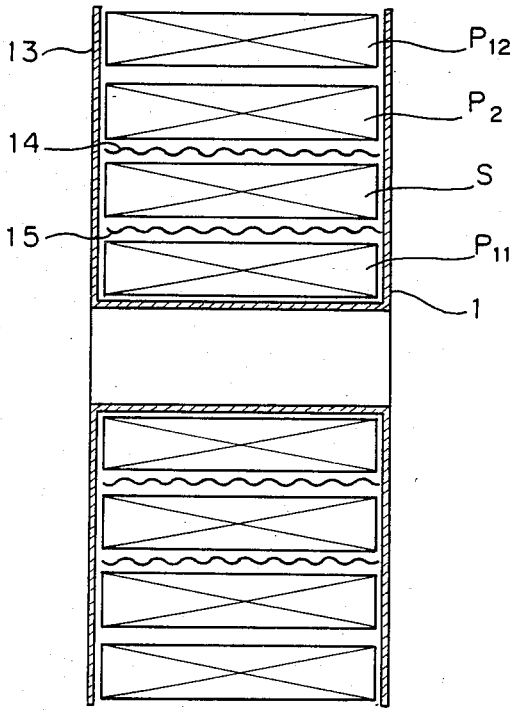
Fig. 4 PRIOR ART
FIG. 4 is a cross sectional view of the coil apparatus having the circuit structure of FIG. 3.

The winding arrangement of the present coil apparatus is as follows. The winding $P_{11}$ is fitted on the hollow member of the inner bobbin 22. Then, the winding $P_2$ is fitted on the winding $P_{11}$. Further, the winding $P_{12}$ is fitted on the winding $P_2$. In other words, as to the primary windings, the winding $P_2$ is sandwiched between two divided windings $P_{11}$ and $P_{12}$. It should be noted that this arrangement for the primary side is the most important feature of the present embodiment. As will explained later with reference to the experimental results, the winding arrangement such that a not divided winding is sandwiched between divided windings offers the advantages that the magnetic coupling between the primary side and the secondary side is improved and that the leakage inductance is small, as compared with the winding arrangement shown in FIG. 2. In particular, those advantages is remarkable when the switching frequency for driving the coil apparatus is rather high (in the order of about 100 kHz) or the output power of the coil apparatus is rather high (in the order of 40–60W). On the other hand, the secondary winding S is wound on the hollow member of the outer bobbin 23.

Preferably, each of two divided windings $P_{11}$ and $P_{12}$ is formed by intertwined wires or a bunch of element wires which are arranged in a row. The windings $P_2$ and S is formed by a single strand wire. It has been found from the experimental results that the use of intertwined wires or a bunch of wires facilitates the improvement of the magnetic coupling and the decrease of the leakage inductance, as compared with the case where a single strand wire is used to form the windings $P_{11}$ and $P_{12}$. The diameter of each of element wires which are intertwined or arranged in a row may be suitably selected. The number of those wires is preferrably 3 or 4. Further, the density of the twist of the element wires is one of the factors to determine the magnetic coupling, and is selected so that the divided windings $P_{11}$ and $P_{12}$ are wound in a high density.

Figure 7:
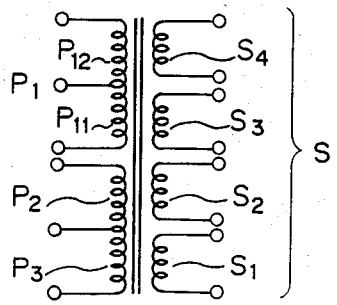
FIG. 7 is a circuit diagram of a coil apparatus according to the second embodiment of the present invention.

FIG. 7 is a circuit diagram of the coil apparatus according to the second embodiment of the present invention. The primary side of the coil apparatus is composed of three windings $P_1$, $P_2$ and $P_3$ which are called the main winding, the reset winding and the trigger winding, respectively. As shown in FIG. 7, the main winding $P_1$ is divided into two windings $P_{11}$ and $P_{12}$ which are connected to each other in series. On the other hand, the secondary side is composed of four windings $S_1$, $S_2$, $S_3$ and $S_4$.

Figure 8:
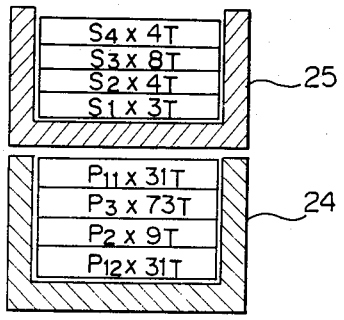
FIG. 8 is a partial cross sectional view of the coil apparatus according to the second embodiment, FIGS. 9(*a*) through 9(*c*) show the experimental results when the stranded wire is used, and FIGS. 10(*a*) through 10(*c*) show the experimental results when a bunch of wires which are arranged in a row are used.

FIG. 8 is a partial cross sectional view of the coil apparatus according to the second embodiment. The primary windings $P_{12}$, $P_2$, $P_3$ and $P_{11}$ for an inner coil bobbin 24 are laminated in this order. In other words, the windings $P_2$ and $P_3$ are sandwiched between the divided windings $P_{12}$ and $P_{11}$. Of course, the primary windings may be laminated in order of $P_{11}$, $P_3$, $P_2$ and $P_{12}$. On the other hand, the secondary windings for an outer coil bobbin 25 are laminated in order of $S_1$, $S_2$, $S_3$ and $S_4$. As will be apparent from the foregoing, the most important feature is that one primary winding $P_1$ which handles the largest current is divided into two windings $P_{11}$, $P_{12}$ and that the remaining primary windings $P_2$, $P_3$ are sandwiched between the two divided windings $P_{11}$, $P_{12}$.

The description will now be given of the experimental results.

The specifications of the coil apparatus to be experimented is as follows.

(1) The circuit structure shown in FIG. 7 was used. This circuit structure is suitable to a forward converter.

(2) The winding arrangement shown in FIG. 8 was used.

(3) The divided windings $P_{11}$ and $P_{12}$ were formed by using two types of wires (intertwined wires, and bunched wires) mentioned before.

(4) Turns of the primary windings $P_{12}$, $P_2$, $P_3$ and $P_{11}$ are 31, 9, 73 and 31, respectively. Further, turns of the secondary windings $S_1$, $S_2$, $S_3$ and $S_4$ are 3, 4, 8 and 4.

Figure 9:
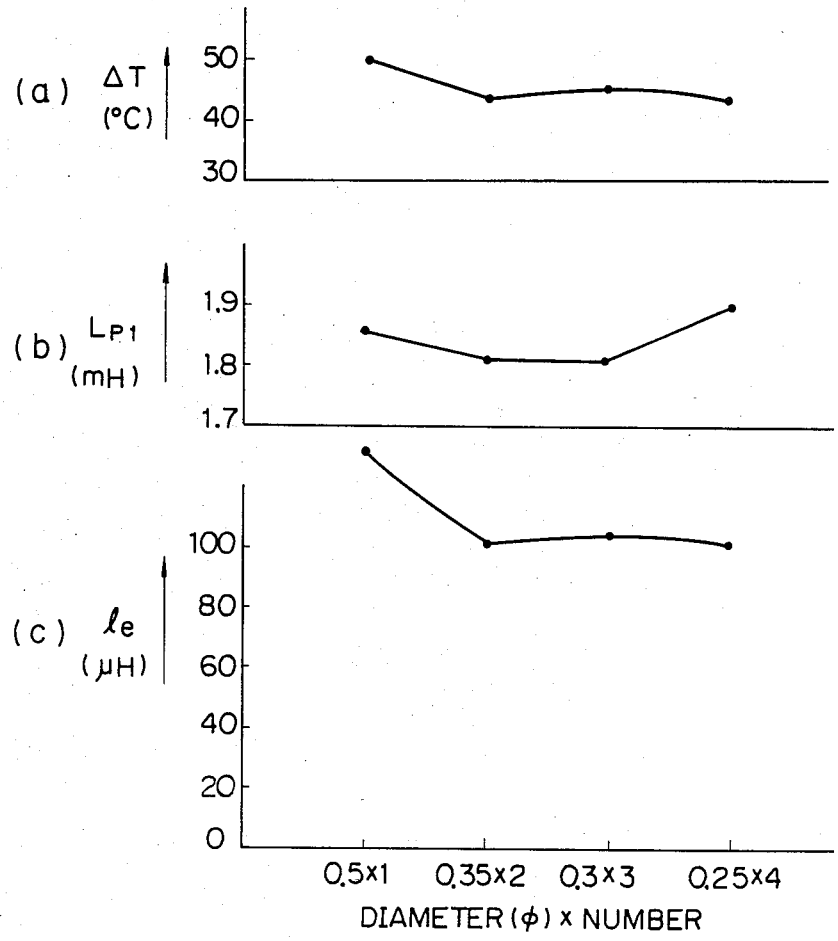
Figure 10:
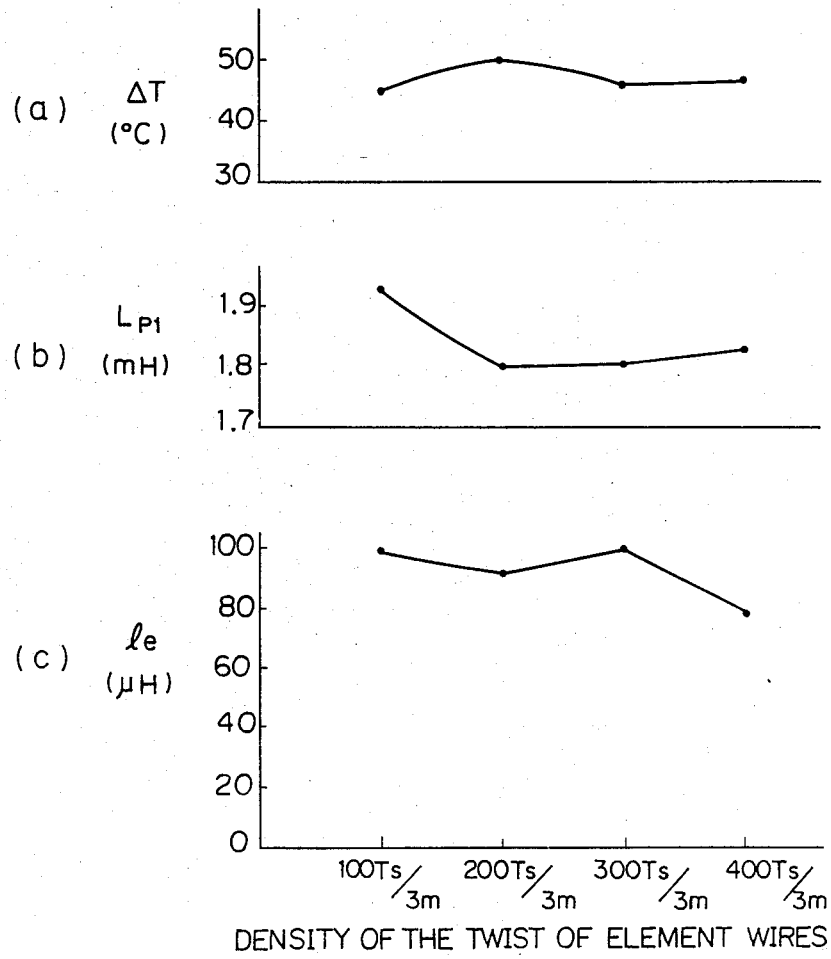

FIG. 9 shows the experimental results when bunched wires are used, and FIG. 10 shows the experimental results when intertwined wires were used. In details, the abscissas of FIGS. 9(*a*) through 9(*c*) show the combination of the number of wires and the diameter $\phi$ of each wire, and the ordinates of FIG. 9(*a*) through 9(*c*) show the temperature increase $\Delta T$(° C.), the self-inductance $L_{p1}$ (mH) and the leakage inductance le ($\mu$H). Furthermore, the abscissas of FIGS. 10(*a*) through 10(*c*) show the density of the twist of the element wires and the ordinates of FIGS. 10(*a*) through 10(*c*) show the temperature increase $\Delta T$(° C.), the self-inductance $L_{p1}$ (mH) and the leakage inductance le ($\mu$H), respectively.

It is apparent from FIG. 9 that the leakage inductance le and the temperature increase $\Delta T$ in the case where the windings $P_{11}$, $P_{12}$ is formed by the bunched wires are small as compared with those in the case where the windings $P_{11}$, $P_{12}$ is formed by a solid wire. Thus, it is understood that the magnetic coupling is improved by the winding arrangement of FIG. 8. Furthermore, as apparent from FIG. 10, the use of the intertwined wire offers the similar effects as in the case where a bunch of wires arranged in a row is used.

From the foregoing, it will be apparent that a new and improved coil bobbin has been found. It should be understood of course that the embodiments disclosed are merely illustrative and are not intended to limit the scope of the invention. Reference should be made to the appended claim, therefore, rather than the specification as indicating the scope of the invention.

What is claimed is:

1. A coil apparatus comprising an inner coil bobbin with a central axis and having a hollow member on which at least two primary windings are fitted, each primary winding having at least one terminal not connected to a terminal of the other primary winding and adapted to receive a voltage different from the voltage to the other primary winding, and an outer coil bobbin having a hollow member on which at least a secondary winding is fitted having terminals at least one of which is not connected to any terminal of a primary winding, said hollow member of said inner bobbin being inserted into said hollow member of said outer bobbin, characterized in that one of said primary windings is divided into two windings which are electrically connected in series with each other and the said remaining other primary winding is sandwiched between said two divided windings, and all the primary windings are piled one on top of the other in the direction perpendicular to the said axis.

2. A coil apparatus according to claim 1, wherein said divided windings are formed by winding a pluarlity of element wires.

3. A coil apparatus according to claim 2, wherein said pluarlity of element wires are intertwined.

4. A coil apparatus according to claim 2, wherein said plurality of element wires are bunched together so as to be arranged in a row.

* * * * *